US005598821A

United States Patent [19]

Terata et al.

[11] Patent Number: 5,598,821

[45] Date of Patent: Feb. 4, 1997

[54] MISFIRE DETECTION SYSTEM FOR AN INTERNAL COMBUSTION ENGINE

[75] Inventors: Shukoh Terata; Kenichi Maeda; Shigetaka Kuroda; Yuichi Shimasaki; Masaki Kanehiro; Takuji Ishioka; Takashi Hisaki; Jiro Takagi; Eitetsu Akiyama; Shigeki Baba; Shigeru Maruyama, all of Saitama, Japan

[73] Assignee: Honda Giken Kogyo Kabushiki Kaisha, Tokyo, Japan

[21] Appl. No.: 443,567

[22] Filed: May 18, 1995

Related U.S. Application Data

[63] Continuation of Ser. No. 149,271, Nov. 9, 1993, abandoned.

[30] Foreign Application Priority Data

Nov. 10, 1992 [JP] Japan ..... 4-326014

[51] Int. Cl.[6] ..... F02P 5/00

[52] U.S. Cl. ..... 123/406

[58] Field of Search ..... 123/406, 425, 123/419, 422, 436, 630, 399; 364/431, 431.08; 324/399; 73/116

[56] References Cited

U.S. PATENT DOCUMENTS

| | | | |
|---|---|---|---|
| 5,078,112 | 1/1992 | Ikeura | 123/406 |
| 5,168,854 | 12/1992 | Hashimoto et al. | 123/425 |
| 5,207,200 | 5/1993 | Iwata | 123/425 |
| 5,241,937 | 9/1993 | Kanehiro et al. | 123/419 |
| 5,268,843 | 12/1993 | Imai | 364/431.08 |
| 5,287,836 | 2/1994 | Shimasaki et al. | 123/406 |
| 5,305,635 | 4/1994 | James et al. | 73/116 |
| 5,309,756 | 5/1994 | Osawa et al. | 73/116 |
| 5,327,867 | 7/1994 | Hisaki et al. | 123/406 |
| 5,337,716 | 8/1994 | Fukui et al. | 123/425 |
| 5,383,434 | 1/1995 | Kugker et al. | 123/419 |
| 5,388,560 | 2/1995 | Hisaki et al. | 123/425 |
| 5,437,253 | 8/1995 | Hoffmaster et al. | 123/399 |

FOREIGN PATENT DOCUMENTS

| | | |
|---|---|---|
| 1-178740 | 7/1989 | Japan . |
| 1-178736 | 7/1989 | Japan . |
| 3-45475 | 4/1991 | Japan . |
| 3-45434 | 4/1991 | Japan . |
| 4-109075 | 4/1992 | Japan . |
| 5-65866 | 3/1993 | Japan . |
| 5-164033 | 6/1993 | Japan . |

*Primary Examiner*—Raymond A. Nelli

*Attorney, Agent, or Firm*—Nikaido Marmelstein Murray & Oram LLP

[57] ABSTRACT

A high probability of detecting an erroneous misfire occurs when combustion becomes unstable during jolt control. Therefore, during jolt control the reliability of the misfire detection system is degraded. As a result, the misfire detection system is inactivated during jolt control by discontinuing the misfire detection, or by deliberately deeming no misfire has occurred if jolt control has occurred. Alternatively, the misfire detection sensitivity is masked during jolt control.

22 Claims, 9 Drawing Sheets

(h)

MISFIRE DETECTION SYSTEM FOR AN INTERNAL COMBUSTION ENGINE

This application is a continuation of application Ser. No. 08/149,271 filed Nov. 9, 1993, abandoned.

BACKGROUND OF THE INVENTION

1. Field of the Invention

This invention relates to a misfire detection system for an internal combustion engine, and more particularly to such a system in which misfire detection is inactivated under specified operating conditions.

2. Description of the Prior Art

The cause for misfiring in an internal combustion engine may be related to either the fuel supply system or the ignition system of the engine. The assignee previously proposed a system for detecting misfire caused by the fuel supply system (Japanese Laid-Open Patent Publication No. 5(1993)-65866) and a system designed to improve misfire detection accuracy by prohibiting the making of misfire detections when engine combustion is apt to become unstable, as when the fuel injection system controls the air/fuel to be lean, or when the fuel supply is being cut (Japanese Laid-Open Patent Publication No. 5(1993)-164033) .

In a vehicle equipped with an automatic transmission, the engine output is sometimes deliberately reduced, such as by retarding the ignition timing, by making the air/fuel ratio lean or by cutting off the fuel supply, in order to reduce the shock the passengers feel during gear ratio shifting. Similar engine output reduction control is also conducted for mitigating swaying oscillation of the propeller shaft or the like caused by output transmission lag. Since combustion becomes unstable during control of this kind, the probability of erroneous misfire detection is high. This degrades the reliability of the misfire detection system.

SUMMARY OF THE INVENTION

This invention was accomplished in light of the foregoing circumstances and has as its object to provide a misfire detection system for an internal combustion engine which deactivates misfire detection under specified operating conditions deliberately implemented for reducing engine output, thereby improving misfire detection accuracy and enhancing the misfire detection system's reliability.

For realizing the object, the present invention provides a system for detecting misfire for an internal combustion engine, comprising, a first device for detecting whether misfire has occurred in the engine, a second device for detecting a specific engine operating condition in which a vehicle on which the engine is mounted is to be degraded in its running performance, a third device for adjusting a command value which reduces output of the engine when the specific engine operating condition is detected, and a fourth device for inactivating the operation of the first device when the third device adjusts the command value.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

Embodiments of the invention will now be explained with reference to the drawings.

Figure 1:
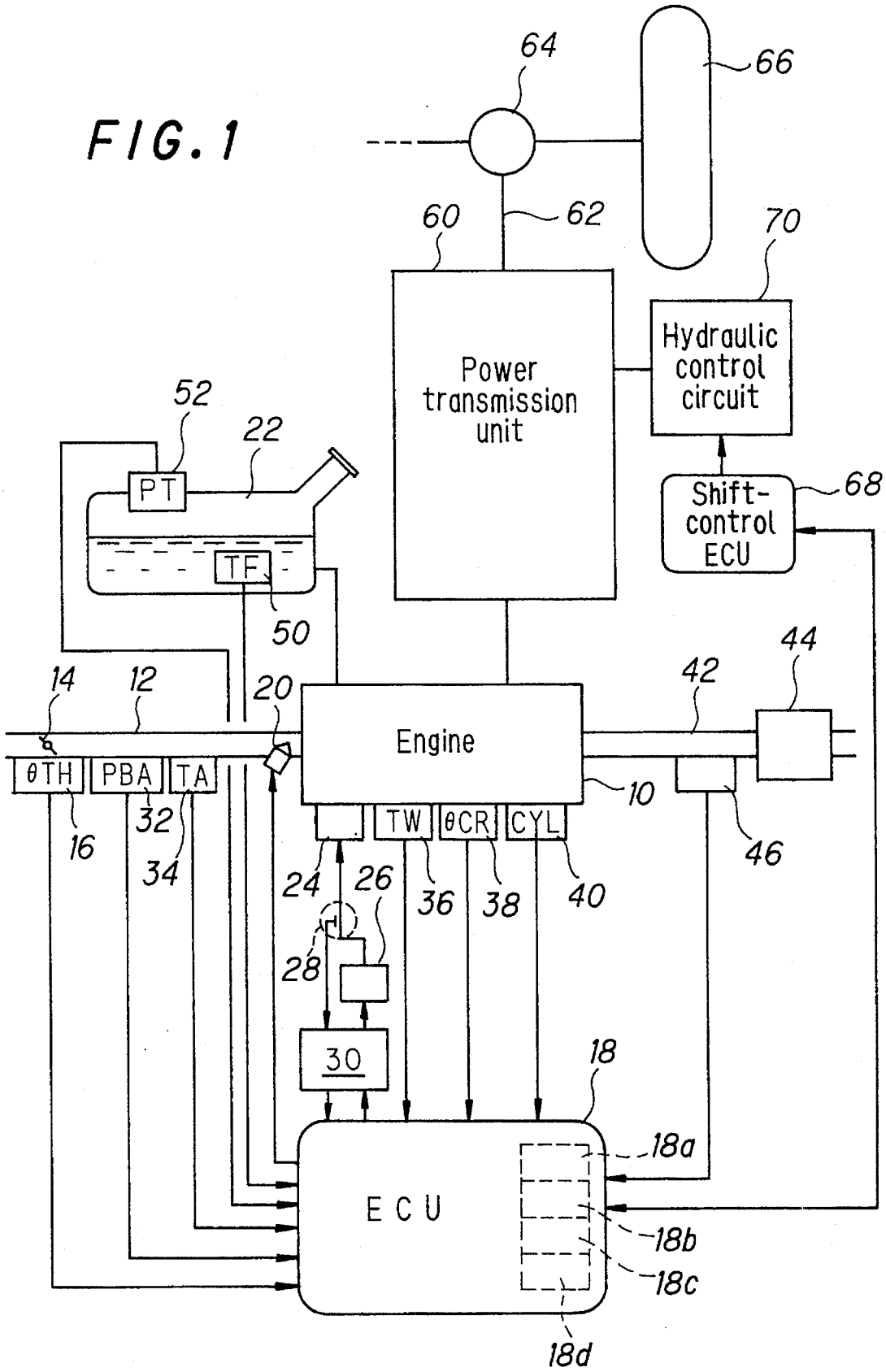
FIG. 1 is a schematic view showing the overall configuration of the misfire detection system for an internal combustion engine according to the invention.

The overall configuration of the misfire detection system for internal combustion engines according to the invention is shown schematically in FIG. 1. A throttle valve 14 is provided in an intake manifold 12 of, for example, a four cylinder engine 10. The throttle valve 14 has a throttle position sensor 16 associated therewith for outputting an electric signal representing the amount of opening of the throttle θTH to an electronic control unit, hereinafter referred to as ECU, 18.

For each cylinder, a fuel injection valve 20 is provided in the intake manifold 12 between the engine 10 and the throttle valve 14 at a point immediately upstream of an intake valve (not shown). Each fuel injection valve 20 is supplied with fuel from a fuel tank 22 via a fuel pump etc. (not shown) and is also electrically connected with the ECU 18, which supplies it with a drive signal for controlling its open time (injection time) TOUT. Spark plugs 24 associated with the respective cylinders of the engine 10 are electrically connected through an ignition distributor 26 with the ECU 18 which controls their ignition timing θIG. The lines connecting the spark plugs 24 and the ignition distributor 26 have ignition voltage sensors 28 capacitively coupled therewith so as to form multi-pF capacitors with the lines. The detection signals produced by the ignition voltage sensors 28 are forwarded to the ECU 18.

The output of a manifold absolute pressure sensor 32 installed immediately downstream of the throttle valve 14 is converted to an electric signal indicative of manifold absolute pressure PBA that is forwarded to the ECU 18. An intake air temperature sensor 34 is installed down-stream of the manifold absolute pressure sensor 32 for detecting the intake air temperature TA and outputting a corresponding signal to the ECU 18.

An engine coolant temperature sensor 36 is installed in a cooling water passage (not shown) of the engine 10 for detecting the engine coolant temperature TW and outputting a corresponding signal to the ECU 18. In addition, a crankshaft sensor 38 and a camshaft position sensor 40 are installed in the vicinity of the crankshaft and camshaft (neither shown), for outputting a pulse signal θCR or CYL to the ECU 18 once every prescribed crank angle, respectively. The ECU 18 calculates the engine speed from the number of pulse signals θCR output by the crankshaft sensor and identifies from the output of the camshaft position sensor which cylinder is at a predetermined crank angular position.

The engine 10 is provided with an exhaust pipe 42 which in turn is equipped with a three-way catalytic converter 44 for purifying the exhaust gas and, upstream of the three-way catalytic converter 44, with an oxygen concentration sensor 46 for sending to the ECU 18 an output proportional to the oxygen concentration $O_2$ of the exhaust gas. The fuel tank 22 is equipped with a fuel temperature sensor 50 for detecting the fuel temperature TF and with a tank pressure sensor 52 for detecting the in-fuel tank pressure PT, the outputs of which are sent to the ECU 18.

The ECU 18, which is constituted as a microcomputer comprising an input circuit 18*a* for shaping, voltage level adjusting and A/D converting input signals, a CPU 18*b*, a memory 18*c*, and an output circuit 18*d*. The ECU 18 controls the fuel injection time TOUT and the ignition timing θIG in accordance with the operating conditions ascertained from the sensor detection values. It also determines the occurrence of misfire on the basis of input received from a misfire detection circuit 30.

A power transmission unit 60 equipped with an automatic transmission is connected to the engine 10 for converting the engine output and transmitting it to driven wheels 66 via a propeller shaft 62 and a differential 64. The power transmission unit 60 is equipped with another ECU 68 for shift control. The ECU 68 selects the gear ratio (gear position) on the basis of the vehicle speed, the throttle opening and the like, and operates a hydraulic control circuit 70 for shifting the automatic transmission to the selected gear ratio. The shift-control ECU 68 is constituted similarly to the ECU 18 and the two ECUs are able to communicate with each other via a signal line.

Figure 2:
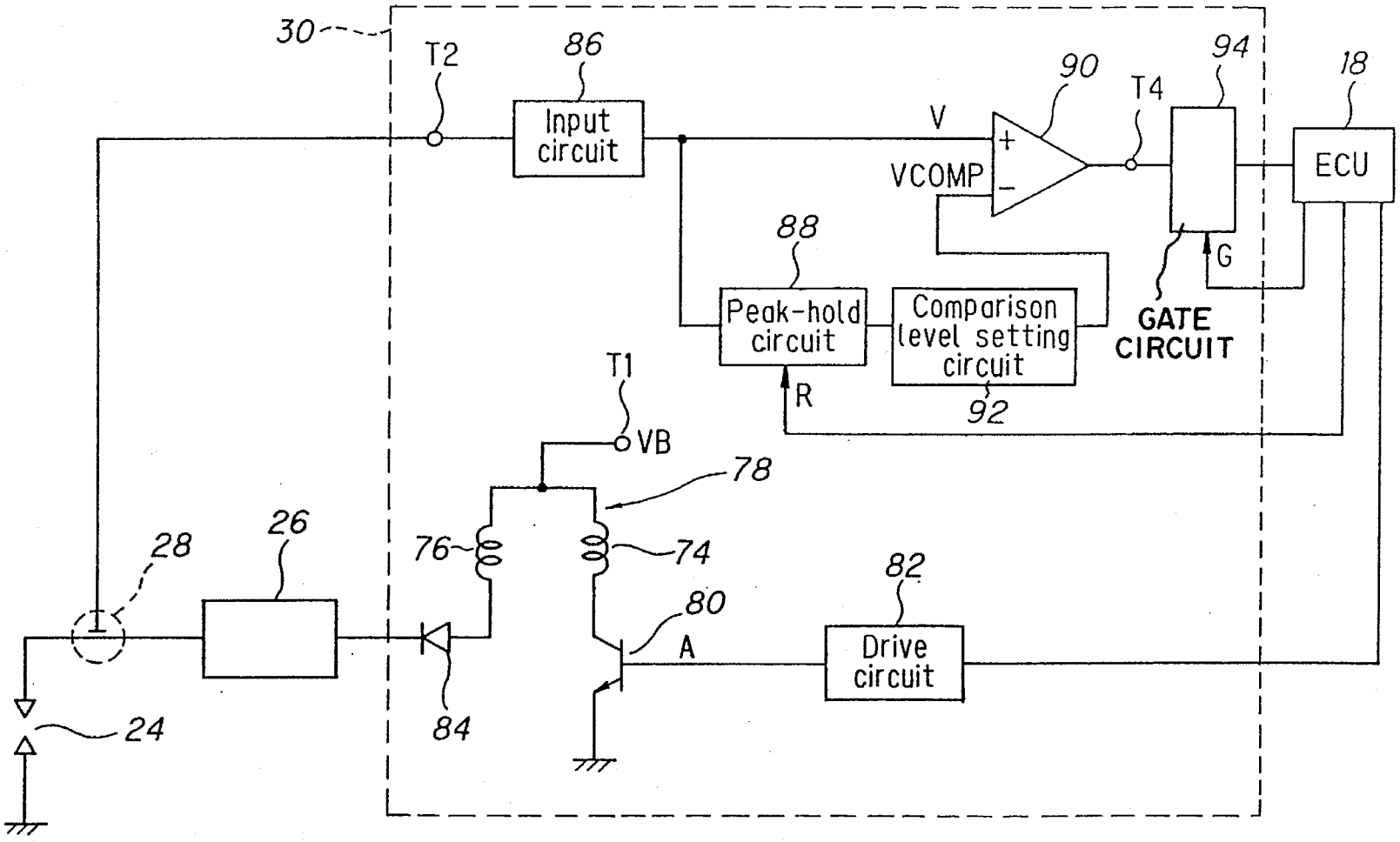
FIG. 2 is a schematic view showing the overall configuration of the misfire detection circuit illustrated in FIG. 1.

The configuration of the misfire detection circuit 30 is illustrated in detail in the block diagram of FIG. 2. A terminal T1 supplied with power source voltage VB is connected with an ignition coil 78 consisting of a primary coil 74 and a secondary coil 76. The primary coil 74 is connected with the ECU 18 through a transistor 80 and a drive circuit 82, while the secondary coil 76 is connected with the center terminal of each spark plug 24 through a diode 84 and the ignition distributor 26. At each cylinder, the ignition voltage sensor 28 mentioned above is connected with an input circuit 86 through a terminal T2, and the output of the input circuit 86 is forwarded to a peak-hold circuit 88 and the non-inverting input terminal of a comparator 90. The output of the peak-hold circuit 88 is applied to the inverting input terminal of the comparator 90 through a comparison level setting circuit 92 which produces and sends a reference value VCOMP to the terminal. The reset input terminal of the peak-hold circuit 88 is connected with the ECU 18. The output of the comparator 90 is sent to the ECU 18 through a terminal T4 and a gate circuit 94. The gate circuit 94 receives a gate signal from the ECU 18.

Figure 3:
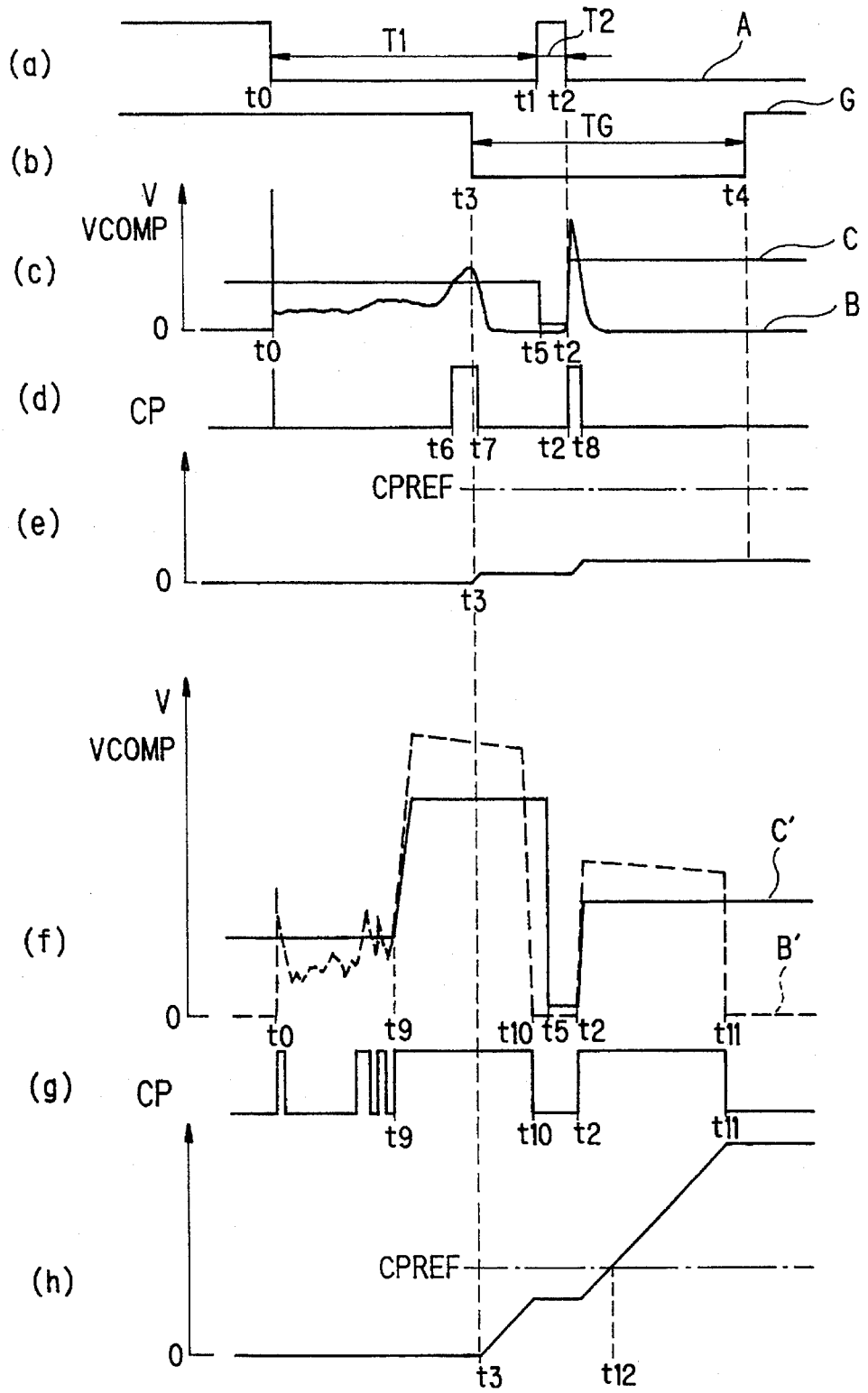
FIG. 3 is a timing chart showing the operation of the misfire detection circuit illustrated in FIG. 2.

The operation of the misfire detection circuit 30 will be briefly explained with reference to FIG. 3. In FIG. 3, (a) indicates ignition command signal A, (b) indicates gate signal G, (c) through (e) indicate the case where combustion occurs (misfire does not occur), and (f) through (h) indicate the case where combustion does not occur (misfire occurs). After an ignition command signal A has been issued at time t0, a voltage of a level not high enough to cause spark discharge is applied between the terminals of the spark plug 24 during a time T2. When misfire occurs due to a problem in the fuel supply system, the air-fuel mixture does not ionize, creating a resistance between the spark plug electrodes larger than when the air-fuel mixture's ionization does occur. As a result, the detection value of the ignition voltage sensor is higher than when combustion occurs. Therefore, if a value (marked as C or C' in the figure), equal to about ⅔ of the peak value of the ignition voltage (marked as B or B') is set in the comparison level setting circuit as the reference value VCOMP for comparison with the sensor detection value B, B', the width of the output pulse CP of the comparator 90 (shown at (g)), will be larger than in the case where combustion occurs (shown at (d)). If the width of the pulse CP is integrated over the gate interval TG (from time t3 to time t4), as illustrated at (e) or (h) in the figure, and compared with another reference value CPREF, it is possible to detect whether or not combustion occurred; i.e., to detect whether or not misfire occurred. This detection is explained in detail in the assignee's Japanese Laid-Open Patent Publication 5(1993)-164033.

Based on the foregoing, an explanation of the operation of the misfire detection system of the invention will now be explained with reference to the flowchart of FIG. 4. This subroutine is activated at every TDC (top dead center).

First, in S10, a check is made as to whether or not a condition prohibiting misfire detection is in effect. This subroutine is explained in FIG. 5, after which the remainder of the flowchart in FIG. 4 will be explained.

Figure 5:
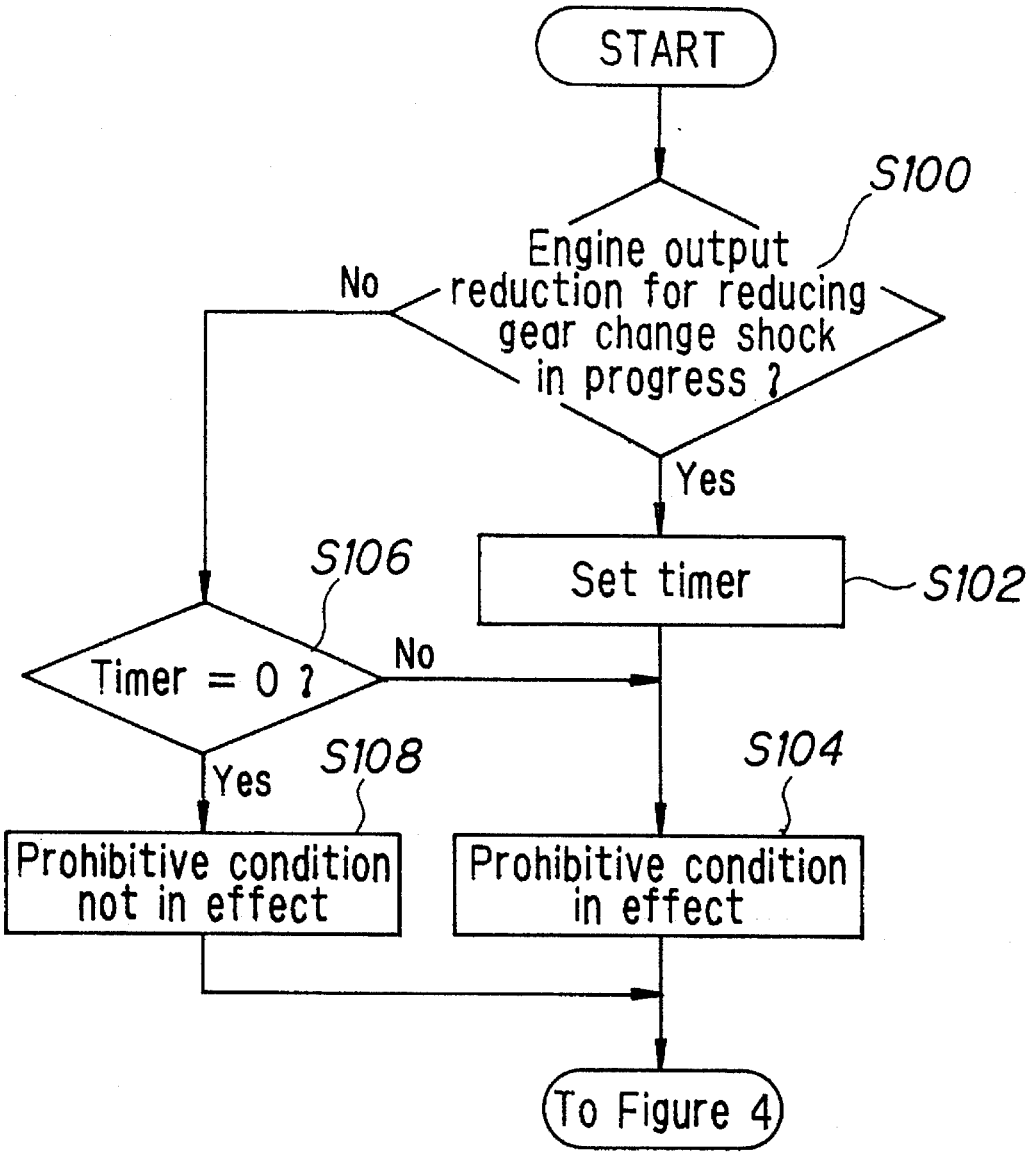
FIG. 5 is a flowchart showing a subroutine for determining a misfire detection prohibitive condition referred to in the flowchart of FIG. 4.

FIG. 5 is the flowchart of a subroutine for checking whether or not such a prohibitive condition is in effect. In S100 a check is made to determine whether or not the aforementioned engine output control for reducing the shock passengers feel during gear change is being conducted. In this control the ECU 18 uses gear change information received from the shift-control ECU 68 as the basis for intentionally lowering the engine output when the transmission is being shifted so as to moderate the shock the passengers feel during gear shifting. The engine output may be lowered by, for example, retarding the ignition timing, making the air/fuel ratio lean, or cutting off the supply of fuel. However, since this control is not directly related to the gist of this invention, it will not be described in detail here. Further description can be found in, for example, the assignee's Japanese Laid-Open Patent Publication 1(1989)-178736, Japanese Laid-Open Patent Publication 1(1989)-178740 and Japanese Laid-Open Utility Model Publication 3(1991)-45434, which propose systems for control of this type.

When it is found in S100 that the control is in progress, the program passes to S102 in which a down count timer is set to a predetermined value and started and to S104 in which it is determined that a prohibitive condition is in effect. If the result in S100 is negative, the program passes to S106 in which a check is made as to whether or not the timer value has reached zero, and if it has not, to S104 in which it is determined that a prohibitive condition is in effect, and if it has, to S108 in which it is determined that a prohibitive condition is not in effect. The reason for maintaining the determination that a prohibitive condition is in effect for a predetermined time after the engine output reduction control has been terminated is that it takes a little time for the combustion to stabilize after the control is stopped. The period of time set in S102 is therefore that required for the combustion to stabilize following control termination.

Returning to FIG. 4, when it is decided in S10 of the flowchart of FIG. 4 that no prohibitive condition is in effect, the program passes to S12 where a check is made as to whether or not a flag IG (which, being set to 1 by a separate subroutine simultaneously with the issuance of an ignition command signal, indicates the aforesaid time t0) is set to 1, and if it is, to S14 in which a check is made as to whether or not the time tR (explained later) clocked by a reset timer is less than a prescribed time tRESET, and if it is, to S16 in which a check is made as to whether or not a pulse (the output pulse CP of the comparator 90) is present. If the pulse is found to be present in S16, the program passes to S18 in which a counter CP for counting up the number of pulses is incremented. (This corresponds to the pulse integration mentioned above.) The program then passes to S20 in which the integrated value is compared with the reference value CPREF. If the integrated value is larger than the reference value CPREF, the program passes to S22 in which it is determined that misfire occurred, and if it is not, the program passes to S24 in which it is determined that misfire did not occur (combustion did occur).

If it is found in S10 that a prohibitive condition is in effect, the routine is immediately terminated. On the other hand, if the result in S12 is negative, the program passes to step S26 in which the time tR of the reset timer is initialized to zero. The time tR clocked by the reset timer and the prescribed time tRESET are for determining the reset timing of the peak-hold circuit 88. Specifically, when the clocked time tR becomes equal to the prescribed time tRESET, the peak-hold value is reset. Therefore, when it is found in S14 that the clocked time tR is equal to or greater than the prescribed time tRESET, the program passes to S28 in which the counter CP is set to zero, to S30 in which the flag IG is set to zero, and to S24 in which it is determined that misfire did not occur (combustion did occur).

In the embodiment under discussion, since misfire detection is not conducted when control is being conducted to deliberately reduce engine output for avoiding gear change shock, there is no danger of erroneous misfire detection. More specifically, the detection is not conducted during the control because the unstable combustion at such times increases the likelihood of detection error and hence the likelihood of the fuel supply system being misjudged to be malfunction. As a result, misfire detection is conducted only during operating conditions that involve little chance of detection error, whereby the detection accuracy is increased and the reliability of the misfire detection system enhanced.

Figure 6:
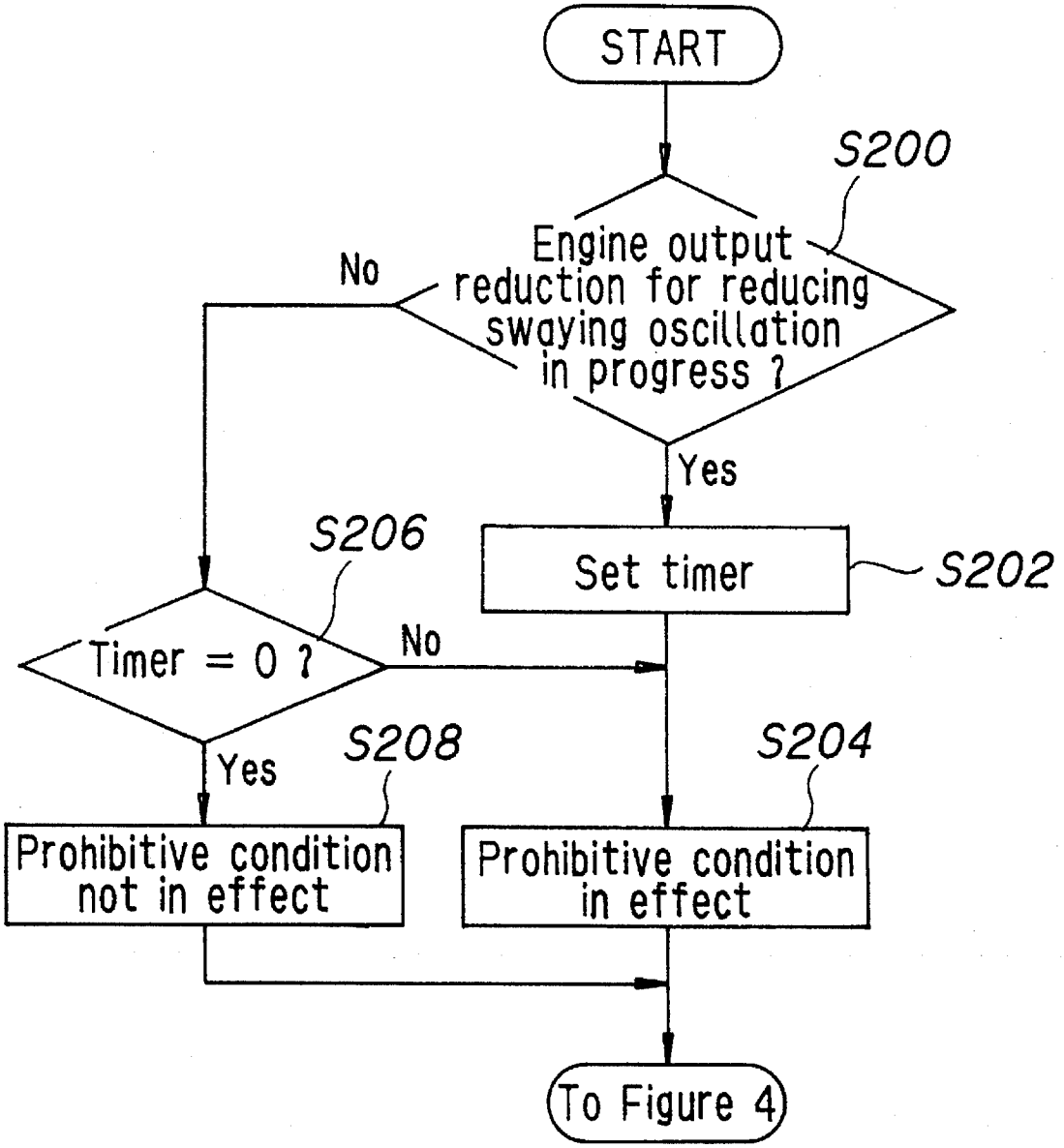
FIG. 6 is a flowchart, similar to FIG. 5, but showing another subroutine of determining a misfire detection prohibitive condition referred to in the flowchart of FIG. 4 according to a second embodiment of the invention.

A second embodiment of the invention is shown in FIG. 6, which is the flowchart of another prohibitive condition discrimination subroutine. In S200 of this second embodiment it is checked if engine output reduction control is being conducted for preventing swaying oscillation of the propeller shaft 62 and the like. Control of this type is conducted so that the vehicle passengers will not experience the torsional vibration that occurs in the shaft etc. during vehicle acceleration because of the time delay in transmitting the increased engine output to the power transmission unit. Whether or not the vehicle is accelerating is determined from the change in air intake manifold absolute pressure PBA or the throttle valve opening θTH. As this is explained, for example, in the assignee's Japanese Laid-Open Patent Publication 4(1992)-109075 and Japanese Laid-Open Utility Model Publication 3(1991)-45475, it will not be discussed further here. The remainder of the procedure, including steps S202 to S208, is the same in nature and effect as the corresponding part of the first embodiment.

Figure 4:
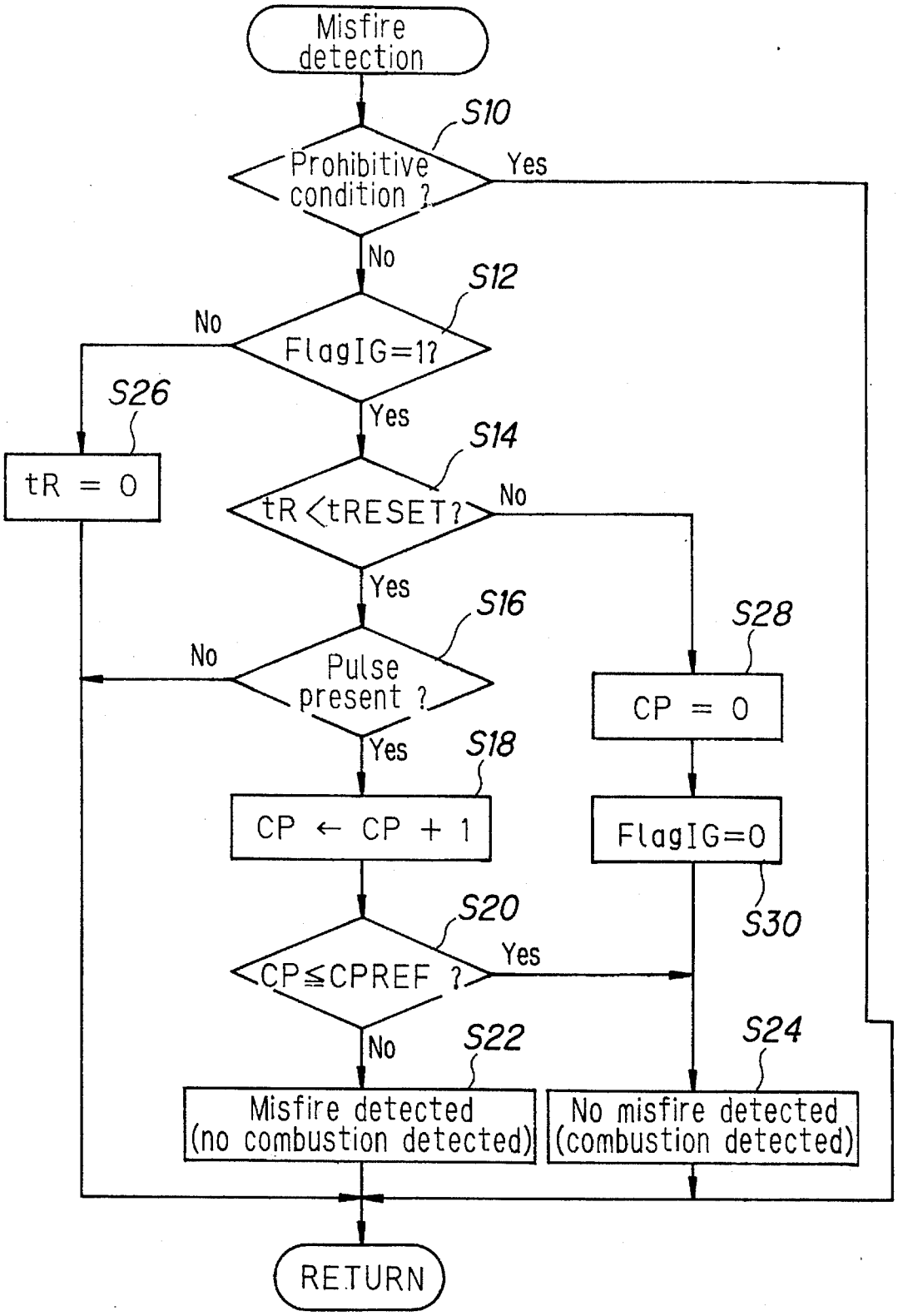
FIG. 4 is a flowchart showing the operation of the misfire detection system according to the invention.
Figure 7:
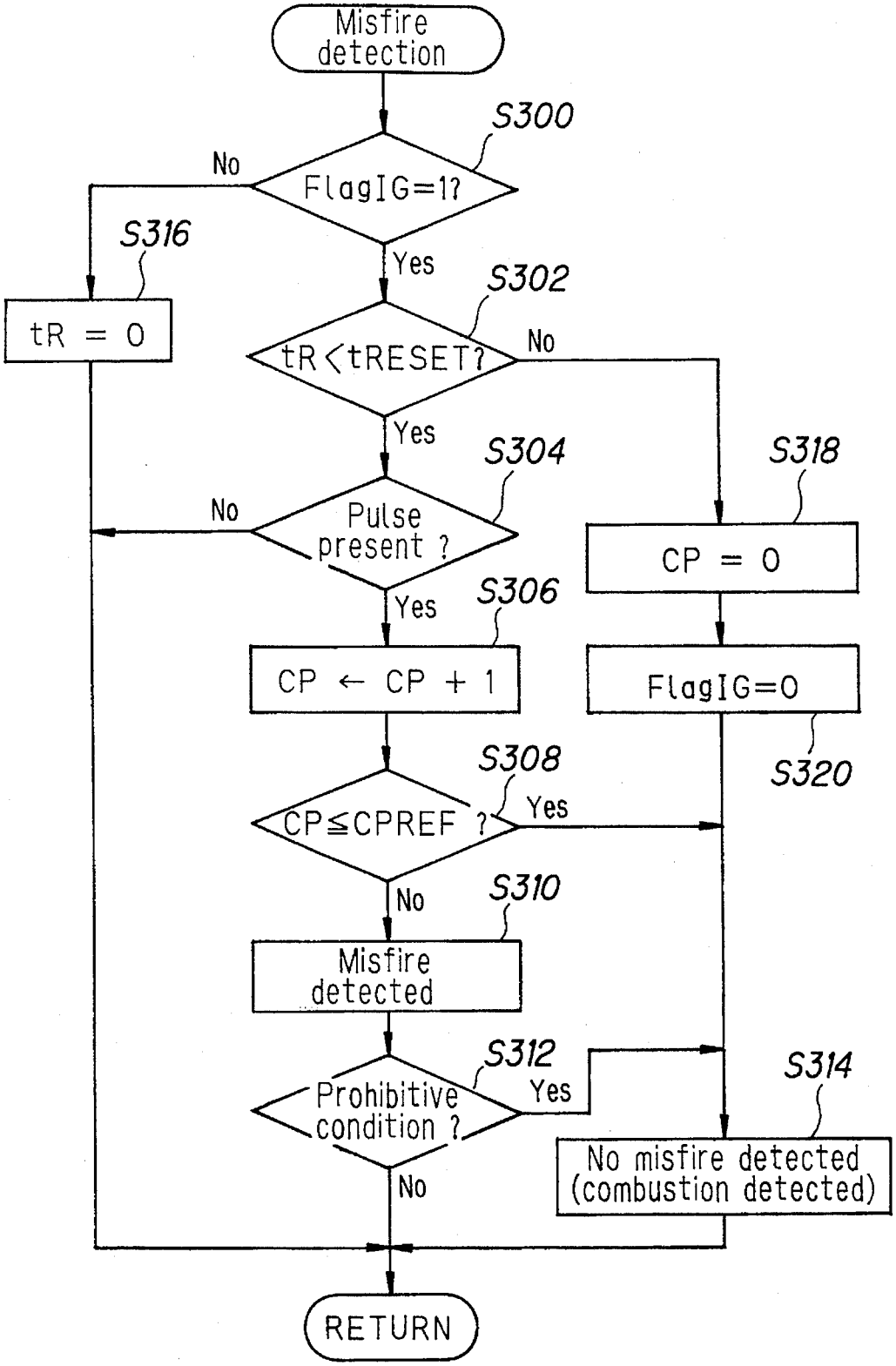
FIG. 7 is a flowchart, similar to FIG. 4, but showing the operation of the misfire detection system according to a third embodiment of the invention.

FIG. 7 is a flowchart similar to that of FIG. 4 relating to a third embodiment of the invention. In the third embodiment, after misfire detection is conducted in S308 and S310, the program passes to S312 in which a decision is made as to whether a prohibitive condition is in effect, and if the result of the decision is affirmative, to S314 in which it is determined that misfire did not occur (combustion did occur). The effect achieved by this embodiment is the same as that of the earlier described embodiments. The remaining steps are the same as those of the first to second embodiments.

Figure 8:
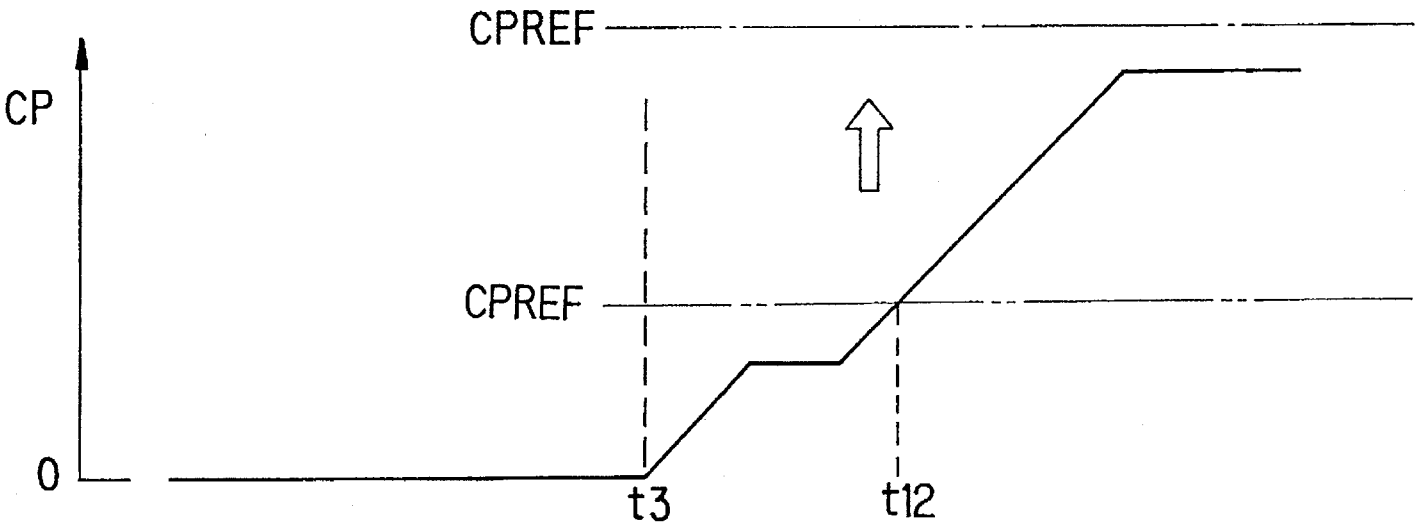
FIG. 8 is a timing chart, similar to a portion of FIG. 3, but showing the operation of the misfire detection system according to a fourth embodiment of the invention.

FIG. 8 is a timing chart, similar to (h) in FIG. 3, and shows a fourth embodiment of the invention. In the fourth embodiment, the reference value CPREF is set higher than the maximum value expected from integrating the pulse CP (the reference value CPREF used in the first embodiment is indicated by a two-dot chain line). Since this eventually prevents a misfire detection from being made under the aforementioned operating conditions, the effect of the fourth embodiment is the same that of the earlier embodiments.

Figure 9:
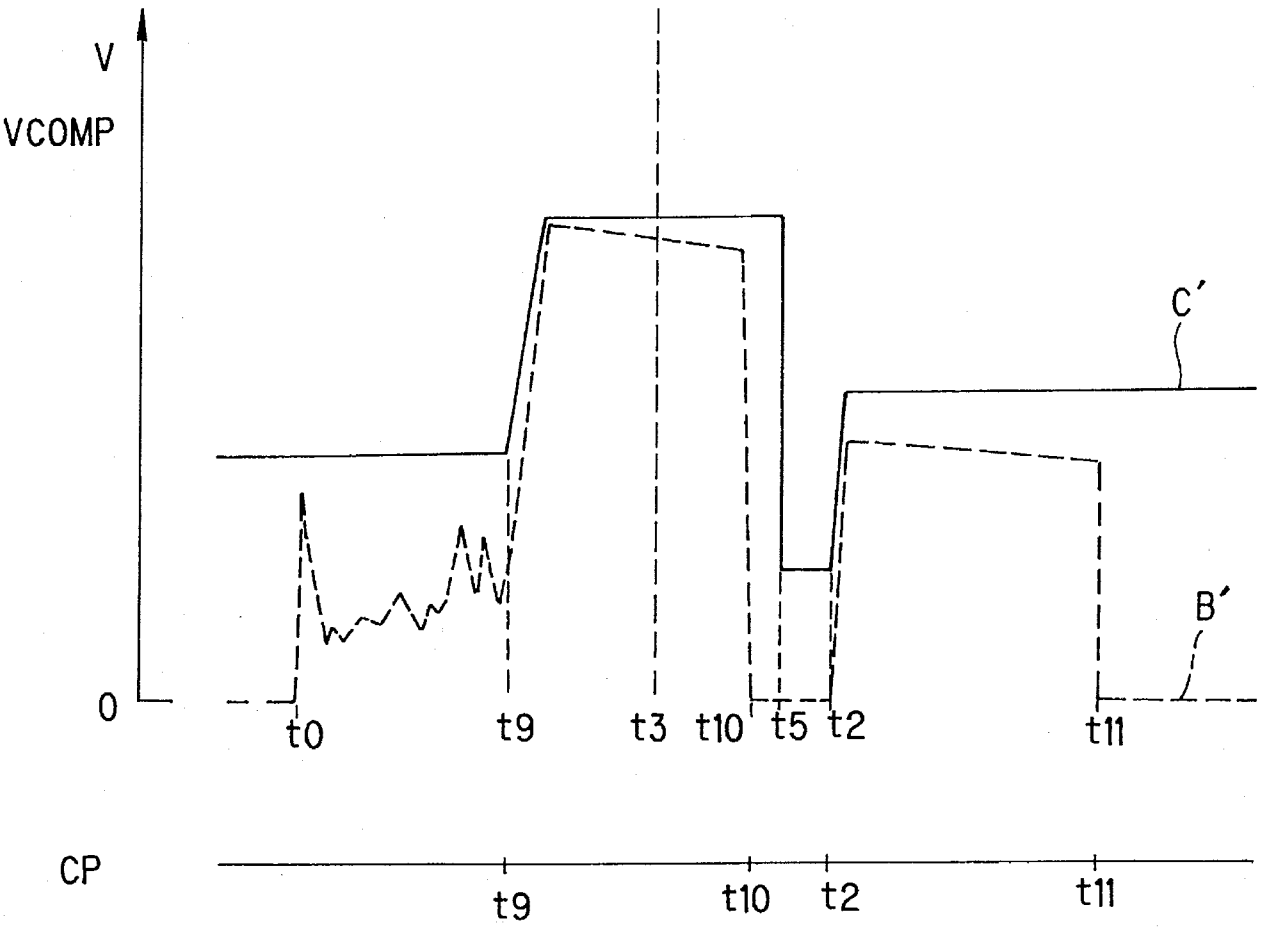
FIG. 9 is a timing chart, similar to a portion of FIG. 3, but showing the operation of the misfire detection system according to a fifth embodiment of the invention.

FIG. 9 is a timing chart, similar to (f) (g) in FIG. 3, and shows a fifth embodiment of the invention. In the fifth embodiment, the reference value VCOMP is set higher than the maximum value expected. Also this eventually prevents the misfire detection similar to the fourth embodiment.

From the fourth and fifth embodiments, it will be easily understood that the same purpose can be achieved by raising both the reference values CPREF and VCOMP higher than necessary.

While it is also possible to use various other techniques, such as masking the gate interval TG, the gist of the invention is that whatever technique is used it suffices to prevent a determination that a misfire occurred from being made during periods when intentional engine output reduction control is being conducted.

Although in the above-described embodiments misfire caused by a problem in the fuel supply system is detected by reapplying a voltage after the ignition command signal has been issued, the invention is not limited to this method and also encompasses other cases such as where misfire detection is conducted on the basis of change in engine speed, as described in Japanese Laid-Open Patent Publication 61(1986)-258955.

Although examples were given in which the engine output reduction control is conducted for avoiding gear shifting shock or for mitigating swaying oscillation during acceleration, the invention is not limited to control for these purposes. Nor is it limited to the method of engine output reduction control described. Alternatively the engine output can be reduced by operating a stepper motor associated with the throttle valve for closing the throttle opening as required.

The present invention has thus been shown and described with reference to the specific embodiments. However, it should be noted that the present invention is in no way limited to the details of the described arrangements; changes and modifications may be made without departing from the scope of the appended claims.

What is claimed is:

1. A system for controlling a vehicle having an internal combustion engine that is connected to a power train including a transmission, said system comprising:

vehicle operational condition detecting means for detecting an operational condition of said vehicle;

engine controller means, operatively coupled to said vehicle operation condition detecting means, for controlling said engine, for determining whether said vehicle is under a predetermined operational condition from an output of said vehicle operational condition detecting means, and for deliberately reducing output of said engine in order to decrease vehicle body vibration generated in the power train during a predetermined vehicle operational condition;

an ignition system including at least one spark plug;

engine operating parameter detecting means for detecting operating parameters of said engine;

ignition timing controller means, operatively coupled to said engine operating parameter detecting means, for determining ignition timing of said engine based on said operating parameters of said engine detected by said engine operating parameter detecting means and generating an ignition command signal indicative of said determined ignition timing;

spark voltage generating means, responsive to said ignition command signal, for generating sparking voltage for discharging said at least one spark plug;

misfire detection means for detecting whether a misfire has occurred in said engine; and misfire detection disablement means for disabling operation of said misfire detection means when said engine controller means deliberately reduces output of said engine.

2. A system according to claim 1, wherein said vehicle is equipped with an automatic transmission and said engine controller means deliberately reduces engine output during gear ratio shifting.

3. A system according to claim 1, wherein said engine controller means deliberately reduces engine output during acceleration.

4. A system according to claim 1, further including;

command signal adjustment means for adjusting said ignition command signal relating to ignition timing to be applied to the engine, such that output of said engine is deliberately reduced.

5. A system according to claim 2, further including:

command signal adjustment means for adjusting said ignition command signal relating to ignition timing to be applied to the engine, such that output of said engine is deliberately reduced.

6. A system according to claim 3, further including:

command signal adjustment means for adjusting said ignition command signal relating to ignition timing to be applied to the engine, such that output of said engine is deliberately reduced.

7. A system according to claim 1, further including;

command signal adjustment means for adjusting a fuel injection command signal relating an air/fuel ratio to be applied to the engine, such that output of said engine is deliberately reduced.

8. A system according to claim 2, further including:

command signal adjustment means for adjusting a fuel injection command value signal relating an air/fuel ratio to be applied to the engine, such that output of said engine is deliberately reduced.

9. A system according to claim 3, further including:

command signal adjustment means for adjusting a fuel injection command value relating an air/fuel ratio to be applied to the engine, such that output of said engine is deliberately reduced.

10. A system according to claim 1, wherein said misfire detection disablement means disables said operation of said misfire detection means by preventing said misfire detection means from detecting occurrence of misfire.

11. A system according to claim 1, wherein said misfire detection disablement means disables said operation of said misfire detection means by forcibly making said misfire detection means to detect no occurrence of misfire even when said misfire detection means has detected occurrence of misfire.

12. A system according to claim 1, wherein said misfire detection means includes;

voltage value detecting means for detecting a value of said sparking voltage generated by said sparking voltage generating means after said ignition timing determining means generates said ignition command signal;

first comparing means for comparing said detected value of said sparking voltage with a first predetermined reference value, measuring means for measuring a degree to which the detected value of said sparking voltage exceeds said first predetermined reference value;

second comparing means for comparing for comparing said degree measured by said measuring means with a second predetermined reference value, and misfire determining means for determining whether a misfire occurs in said engine based on a comparison result obtained by said second comparing means.

13. A system according to claim 12, wherein said first comparing means includes pulse producing means for producing a pulse every time said detected value of said sparking voltage exceeds said first predetermined reference value;

said measuring means includes counting means for counting a width of said pulse as said degree;

said second comparing means compares said width with said second predetermined reference value;

and said misfire determining means determines occurrence of misfire when said counted width of said pulse is found to exceed said second predetermined reference value.

14. A system according to claim 12, wherein said misfire detection disablement means disables said operation of said misfire determining means by increasing said first predetermined reference value.

15. A system according to claim 13, wherein said misfire detection disablement means disables said operation of said misfire determining means by increasing said first predetermined reference value.

16. A system according to claim 13, wherein said misfire detection disablement means disables said operation of said misfire determining means by increasing said second predetermined reference value.

17. A system according to claim 13, wherein said misfire detection disablement means disables said operation of said misfire determining means by increasing both said first and second predetermined reference values.

18. A system according to claim 1, wherein said misfire detection disablement means disables said operation of said misfire determining means for a predetermined period after said engine controller has been terminated.

19. A system according to claim 10, wherein said misfire detection disablement means disables said operation of said misfire determining means for a predetermined period after said engine controller has been terminated.

20. A system according to claim 11, wherein said misfire detection disablement means disables said operation of said misfire determining means for a predetermined period after said engine controller terminated.

21. A system according to claim 14, wherein said misfire detection disablement means disables said operation of said misfire determining means for a predetermined period after said engine controller terminated.

22. A system according to claim 15, wherein said misfire detection disablement means disables said operation of said misfire determining means for a predetermined period after said engine controller has been terminated.

* * * * *

UNITED STATES PATENT AND TRADEMARK OFFICE

CERTIFICATE OF CORRECTION

PATENT NO. : 5,598,821
DATED : February 4, 1997
INVENTOR(S) : TERATA et al.

It is certified that error appears in the above-indentified patent and that said Letters Patent is hereby corrected as shown below:

Column [7], line 50 please delete "relating an" insert therefor --relating to an--.

Column [7], line 55 please delete "relating an" insert therefor --relating to an--.

Column [7], line 60 please delete "relating an" insert therefor --relating to an--.

Column [8], line 65 please delete "said engine controller terminated" insert therefor --said engine controller has been terminated--.

Column [9], line 2 please delete "said engine controller terminated" insert therefor --said engine controller has been terminated--.

Signed and Sealed this
Fifteenth Day of July, 1997

Bruce Lehman

*Attest:*

BRUCE LEHMAN

*Attesting Officer*

*Commissioner of Patents and Trademarks*